United States Patent [19]

Heimdal et al.

[11] 4,147,474

[45] Apr. 3, 1979

[54] METHOD AND SYSTEM FOR TRANSFERRING LIQUID MEDIA

[75] Inventors: Ivar D. Heimdal; Ivar Skreosen, both of Porsgrunn, Norway

[73] Assignee: Norsk Hydro a.s, Oslo, Norway

[21] Appl. No.: 862,321

[22] Filed: Dec. 20, 1977

[30] Foreign Application Priority Data

Dec. 28, 1976 [NO] Norway ..... 764369

[51] Int. Cl.[2] ..... B67C 3/16; F04F 3/00

[52] U.S. Cl. ..... 417/54; 137/205; 417/148

[58] Field of Search ..... 417/148, 54, 149, 543; 137/205

[56] References Cited

U.S. PATENT DOCUMENTS

| | | | |
|---|---|---|---|
| 2,626,138 | 1/1953 | Stevens | 417/148 X |
| 2,889,846 | 6/1959 | Slasby et al. | 417/148 X |
| 3,895,885 | 7/1975 | Liberg | 417/54 |

*Primary Examiner*—William L. Freeh
*Assistant Examiner*—Richard E. Gluck
*Attorney, Agent, or Firm*—Ladas, Parry, Von Gehr, Goldsmith & Deschamps

[57] ABSTRACT

A method for transferring a liquid, particularly liquid metal, from a supply to a receiver. The transfer is carried out by means of at least one suction pump located in the receiver. The outlet of the pump is covered by the liquid being pumped. A buffer zone in shape of a two phase liquid/gas zone is established and maintained between the pump and the supply and liquid from the supply is supplied to the gas phase portion of the buffer zone by discharging the liquid from liquid phase portion of the buffer zone by means of said pump. Precaution is taken that the pump outlet is covered by liquid at all times.

A pumping system for transferring a liquid, particularly liquid metal, from a supply to a receiver comprising a rotary pump with a substantially vertical rotary axis, a closed buffer receptacle which can be subjected to inner suction pressure and has a liquid inlet in the upper portion thereof and a liquid outlet in the lower portion thereof, and comprising conduit means connecting the outlet of the buffer receptacle with the inlet of the pump and means for connecting the inlet of the buffer receptacle with the liquid supply.

11 Claims, 3 Drawing Figures

METHOD AND SYSTEM FOR TRANSFERRING LIQUID MEDIA

BACKGROUND OF THE INVENTION

1. Field of the Invention

The present invention relates to a method for transferring a liquid fluid, particularly liquid metal, such as magnesium, and a transfer system for carrying out said method.

2. Description of the Prior Art

A known method in transferring molten magnesium from a supply vessel to a receiving container comprises using a centrifugal pressure pump mounted near the bottom in the supply vessel to force the metal through a pipe conduit into the receiving container.

As the centrifugal pump must be arranged stationary at the bottom of the supply vessel because the metal level in the vessel is sinking as the metal melt is removed, it is necessary that the pump rotor shaft be quite a long one, e.g. two meters, and, therefore, the lower bearing(s) supporting the shaft have to be located below the molten metal level. These bearings are mounted on a support frame normally comprising a plurality of support struts dimensioned to the length of the shaft and the maximum metal melt level in the vessel. The temperature of the melt is over 700° C. During the operation the bearings and the support struts are subjected to a combination of thermic and dynamic stresses with the consequence that the struts become gradually soft and the shaft bends out of line. The result is that the bearings wear relatively quickly and a pump of the kind stated has normally an operation time of about a week before it has to be dismantled for overhaul.

OBJECTS OF THE INVENTION

Generally, the object of the invention is to provide a new method and a new system for transferring liquid media, particularly liquid metal from a supply vessel to a receiving container, hereafter referred to as "receiver".

SUMMARY OF THE INVENTION

More specially, the invention provides a method, comprising locating at least one suction pump in the receiver, covering at least the outlet of the pump with liquid in the receiver, establishing and maintaining within the receiver an enclosed buffer zone in the shape of a two phase liquid/gas zone between the pump and the supply, pumping the liquid by means of said suction pump from the liquid phase of the buffer zone for establishing suction pressure (vacuum) in the gas phase of the buffer zone for drawing by suction the liquid from the supply through the gas phase into the buffer zone.

According to one aspect of the method of the invention an inert gas atmosphere is at least periodically established in the buffer zone.

Further, the invention provides a system for transferring a liquid medium (hereafter referred to as "liquid"), particularly liquid metal from a supply to a receiver, comprising a rotary pump with a vertical rotor shaft, a closed buffer receptacle having a top and bottom and which can be subjected to inner suction pressure and having a liquid inlet in the upper portion thereof, and a liquid outlet in the lower portion thereof, and comprising means connecting the outlet of the buffer receptacle with the inlet of the pump and means for connecting the inlet of the buffer receptacle with the liquid supply.

The pump may comprise an axial downwardly directed inlet, a radial pump rotor, a rotor housing and a plurality of substantially radial outlet ports in the peripheral wall of the rotor housing. The buffer receptacle may be provided with a substantially horizontal top, the pump being arranged on said receptacle top, the inlet of the pump being connected with the interior of the receptacle near the bottom thereof through a pipe conduit extending through said receptacle top. Preferably, the buffer receptacle in the upper part thereof has means for connection with a source of inert gas.

According to one aspect of the invention, a ring wall may be provided around the rotor housing at a distance from the pump outlets to provide a liquid container having a liquid level covering all outlets.

Normally, the rotor is mounted on the free end of the shaft, said shaft extending upwards from the pump and being supported at a distance above the rotor housing in a support frame mounted on the top of the buffer receptacle.

The rotor housing may be fitted with a cover loosely mounted on the rotor housing wall so that it can be lifted upwards. A distance member is provided between the cover and a portion of the support frame to prevent lifting during operation. In a system in which the cover covers the rotor housing wall, as well as the ring wall, said last mentioned wall has at least one radial outlet opening therein. Preferably the support frame of the pump is divided horizontally into two parts and the driving shaft is journaled in the upper frame portion.

As liquid level in the receiver—as opposed to liquid level in the supply vessel—can be maintained more or less constant, it is possible to locate the pump relatively near the liquid level in the receptacle, so that a great portion of the support frame, the drive shaft and first and foremost the bearings are positioned over the liquid level. In operation, only the rotor, the rotor housing, as well as the lower portion of the shaft and of the frame are subjected to the effect of the hot liquid. Consequently, the lifetime of the shaft bearings is substantially increased. Furthermore, the shaft and the support frame can be made shorter.

As liquid level in the supply vessel is changing during the transfer, it may happen that the level sinks right down to the supply conduit inlet, and air or another gas may be drawn into the conduit. Further, in connection with stopping and starting operations, there is a possibility of air penetration into the supply conduit. When pumping strongly oxidizing liquids, such as molten magnesium, air penetration into the pump must be avoided as this would lead to burning and damaging important components of the pump system. The buffer zone established in accordance with the invention between the supply vessel and the receiving container makes it virtually impossible for the gas to penetrate into the pump inlet. Further, the gas phase of the buffer zone will normally, at least partly, contain an inert gas.

The pump system has also the advantage that the pump can easily be dismantled. The shaft, the pump cover and the rotor can be lifted up out of the housing without the precaution that the receiving container must be emptied of liquid when the components of the pump are still glowing red. As known to experts it is very difficult to disassemble a pump of this kind after the pump components have been cooled down. As almost the whole shaft and the pump shaft bearings are located above the liquid level, the inspection and maintenance service can be carried out relatively easily. The pump wear as well as the servicing costs are, therefore, substantially reduced.

DESCRIPTION OF THE PRESENTLY PREFERRED EMBODIMENT

Figure 1:
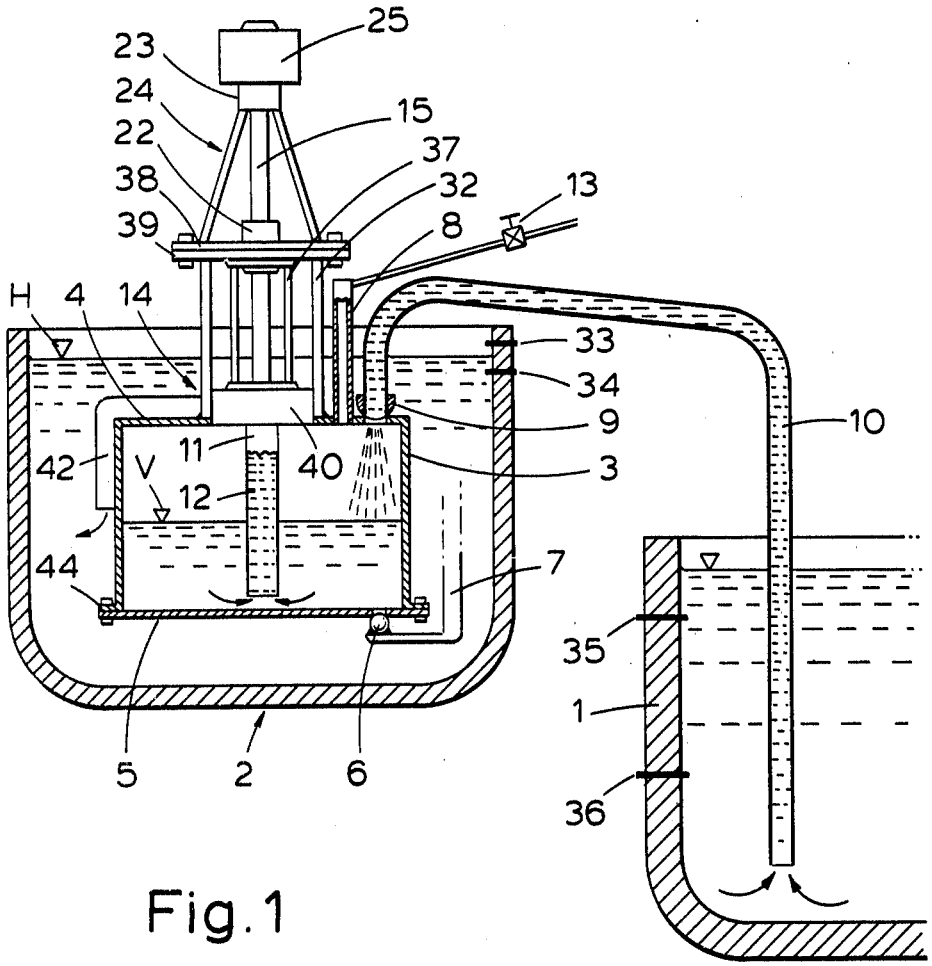
FIG. 1 is a diagrammatical cross-sectional view of a system for transferring liquid in accordance with a method of the invention.

In FIG. 1 a system illustrating the application of the present invention is shown diagrammatically:

A supply vessel 1 is shown containing liquid magnesium, and at a distance and at a higher level, a receiving container 2 (actually a holding receiver) serving to temporary storing liquid magnesium for subsequent delivery e.g. to an ingot mould belt or similar by means of a device not shown.

In the receiver 2, at a certain depth under a predetermined magnesium melt average level H, and at a distance above the bottom of the receiver 2, a cylindric receptacle 3 is provided, having a top wall 4 and a separate bottom 5. In the bottom wall 5 a discharge opening is arranged with a shut ball valve 6, actuated by means of a lever 7 only partially shown for closing the opening. In the top wall 4 a vent and flush pipe socket 8 is provided as well as a joint 9 to a supply conduit 10 connecting the top of the receptacle 3 with the interior of the supply vessel 1. The vent pipe socket 8 is provided with a shut valve 13. In the centre of the receptacle top wall 4 and opening 11 is arranged, a suction pipe 12 extending downwards from said opening. The pipe ends with an opening at a distance from the bottom wall 5. The opposite (upper) end of the pipe 12 is connected to a suction pump as described more closely in the following.

Figure 2:
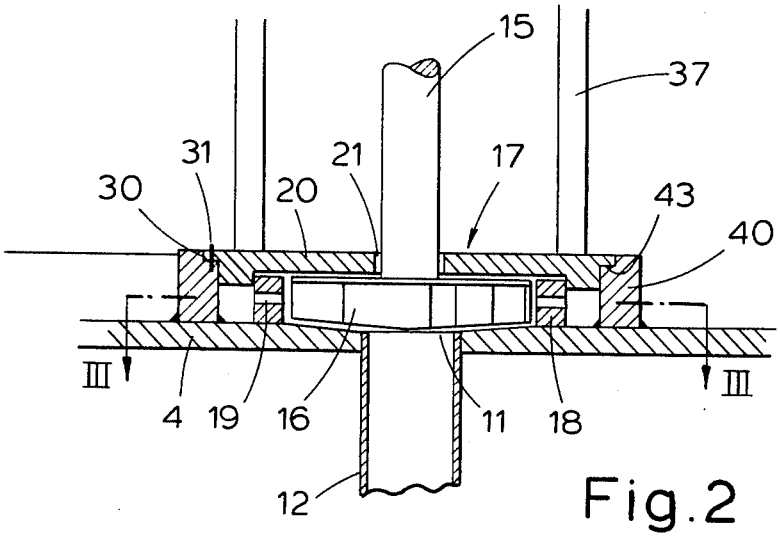
FIG. 2 is a cross-sectional vertical view at a greater scale of the rotor housing and the adjacent portions of the pump in the system illustrated in FIG. 1 taken substantially through line II—II of FIG. 3.
Figure 3:
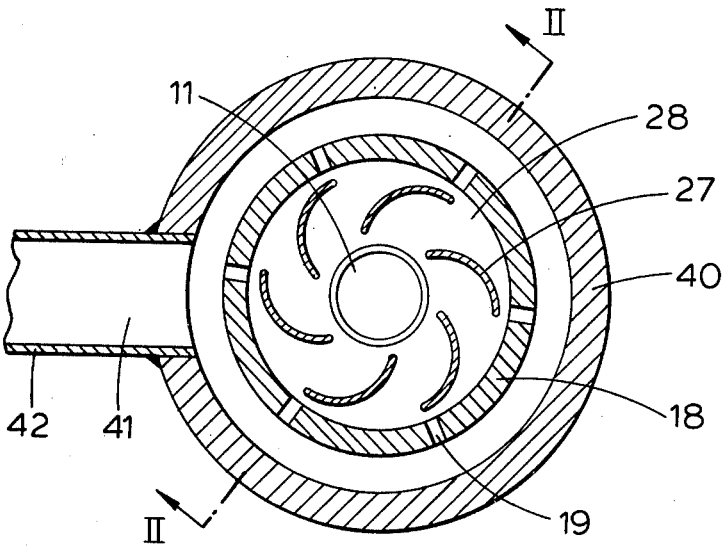
FIG. 3 is a horizontal sectional view taken through line III—III of FIG. 2.

As it appears from FIGS. 2 and 3 the top wall 4 of the receptacle extends rather horizontally and supports a centrifugal pump 14 having a central suction inlet directly connected with, or providing the above mentioned opening 11. Generally, the pump comprises a vertical rotor shaft 15 supporting at its lower end a horizontal rotor 16 arranged in a rotor housing 17. The rotor housing has a peripheral wall 18 shaped with equally spaced radial openings 19 and a top cover 20 with a central opening 21 for passing-through the rotor shaft 15. The radial openings 19 provide the outlet ports of the pump 14. The rotor shaft is journaled in a lower radial bearing 22 and an upper spherical bearing 23, both bearings being carried in a support frame 24 which also supports on the top thereof a driving motor 25. The driving motor is actually a pneumatic rotary motor with adjustable rotary speed, but other prime movers can be used.

The support frame 24 comprises a plurality of supporting struts 32 in case extending parallel to the shaft from the rotor housing 17, the lower ends of the struts being welded to, or otherwise fixedly mounted on the top wall 4 of the housing. As it appears from FIG. 1 the distance between the rotor housing and the lower bearing 22 is relatively short.

The rotor 16 is screwed fixedly on the lower end of the shaft 15. As shown in FIGS. 2 and 3 the rotor comprises a plurality of rotor vanes 27 shaped similarly to vanes in a centrifugal pump and extending outwards from a rotor hub and/or projecting downwards from a radial rotor wall (not shown). The rotor chamber is denoted by 28.

According to FIG. 2 the rotor housing wall 18 is welded directly onto the top wall 4 of the receptacle 3, and the central portion of the top wall 4 which provides the bottom of the rotor housing 17 is sloping suitably towards the suction inlet opening 11 as shown. The radial dimension of the suction inlet opening 11 is greater than that of the rotor hub, provided the hub extends downwards towards the opening 11.

An outer ring wall 40 is at radial distance outside the rotor housing wall 18 welded onto the top 4 of the receptacle 3 and has a height dimension greater than that of the wall 18. The ring wall 40 is provided with at least one outlet 41 merging into a duct 42 extending at first radially across the top wall 4, and then downwards along the side wall of the receptacle 3. Possibly, the ring wall 40 can be made integral with the rotor housing wall 18.

Evidently, the rotor housing 17 can be shaped with a separate bottom (not shown) to which bottom the wall 18 can be welded and such a bottom would be larger, (seen as top view) than the rotor so that it can be easily welded onto the top 4 of the receptacle 3. As also known in FIG. 2 the top or cover 20 of the rotor housing 17 is shaped with a radial flange 30 positioned in a corresponding ring-shaped shoulder 43 in the upper edge portion of the ring wall 40. In other respects, the connection is quite loose and a suitably shaped distance member 37 prevents the cover from being lifted. The upper end of the distance member bears against a horizontal member of the support frame 14. Loose pins 31 prevent the cover 20 from rotation along with the rotor 16.

The support frame 24 comprises one lower frame member and one upper frame member. The lower frame member comprises the support struts 38 and a connecting flange 39 welded onto the top of the struts 38. The upper frame member comprises a connecting flange 38, bolted to the flange 39 and carrying supporting elements mounting the aforementioned shaft bearings 22 and 23, respectively, as well as the driving motor 25. Motor control means are not shown in the drawings.

When the bolt connection is removed, the upper support frame member with the motor, motor shaft, cover and rotor, can be lifted upwards from the rotor housing for dismantling whilst still glowing red. During lifting, the cover 20 will lay itself loosely upon the rotor 16 and will be lifted up along with the rotor and the distance member 37. The rotor 16 is the only portion which should be unscrewed from the shaft. This is possible in a glowing condition even when the screw connection has been in the melt for a long time. When the rotor 16 is removed from the shaft the distance member 37 can be drawn off from the shaft. As mentioned the assembly can be lifted up in glowing-hot condition, when necessary.

The receptacle 3 is made integral except the bottom wall 5 which is arranged removably by means of flange and bolt connections 44.

In the upper part of the wall of the receiver 2, level control electrodes 33,34 are provided and connected with switch contacts (not shown) for switching on or off, respectively, the motor 25 dependent on the liquid level in the receiver. In the supply vessel 1 at least two level control electrodes 35,36 are provided for controlling the speed of the driving motor 25 dependent on the liquid level in the vessel 1.

The operation of the system will now be explained.

Provided the pump assembly 3,14,24 is mounted stationary in the receiver 2, the receiver must be filled with liquid to cover the pump 14 before starting the motor 25. In a case of a transportable pump assembly, it would be lowered down into the receiver 2 by means of a carrier which carries the pump assembly. The receiver 2 may be filled with liquid before or after the pump assembly has been lowered into the receiver. The bottom valve 6 is opened for partly filling the receptacle 3 with liquid well over the inlet to the suction pipe 12 and then closed again (by means of the arm 7). The buffer receptacle 3 may be flushed with a neutral gas, e.g. argon, through the valve 13 and the socket 8 before starting the pump motor 25, but after the receptacle 3 has been connected to the liquid supply in the supply vessel 1. The valve 13 is then shut and the pump is activated by starting the motor 25. The rotor (which is fully covered by liquid in the receiver 2) initiates sucking up the liquid from the receptacle 3 into the receiver 2 and a strong suction pressure is developed above the liquid level V in the receptacle. Consequently, liquid is drawn from the supply vessel 1 into the suction receptacle 3. The level electrodes 33,34 will close, or open, switching on or off, respectively, the motor 25 for controlling the liquid level in the receiver 2.

Should the pump be stopped for a longer time interval, the pipe socket 8 with its valve 13 is connected with a source of inert gas, such as argon, and then opened. The gas flows into the upper portion of the suction receptacle 3 so that the suction pressure is released and the effect of the rotor neutralized. Then the motor 25 and the pump are stopped. The liquid from the receiver 2 then flows into the suction receptacle 3. The liquid in the pumping conduit 10 will flow back to the supply vessel 1 and the gas will expand into the pumping conduit. If the vessel 1 is quite empty of liquid and some air has penetrated into the conduit 10, the air can be removed by gas flushing through the valve 13 and the pipe 8. Should a small amount of air penetrate into the conduit 10 and the receptacle 3 during repeated starting, the air will be so strongly diluted during the establishing of suction pressure in the relatively large suction receptacle that no problems will arise during the operation. The gas, or possibly the mixture of gas and air will never be allowed to penetrate from the gas zone of the suction receptacle into the inlet of the pump because the receptacle 3 at any time is partly or completely (upon stopping) filled with liquid.

What is claimed as invention is:

1. A method for transferring a liquid medium (hereafter referred to as "liquid"), particularly liquid metal, such as magnesium, from a supply to a receiver, comprising locating at least one suction pump in the receiver, covering at least the outlet of the pump with liquid in the receiver, establishing and maintaining within the receiver an enclosed buffer zone in shape of a two phase liquid/gas zone between the pump and the supply, pumping the liquid by means of said suction pump from the liquid phase of the buffer zone for establishing suction pressure (vacuum) in the gas phase of the buffer zone for drawing by suction the liquid from the supply through the gas phase into the buffer zone.

2. A method according to claim 1, in which an inert gas atmosphere at least periodically is established in the buffer zone.

3. A pumping system for transferring a liquid medium (hereafter referred to as "liquid"), particularly liquid metal, such as magnesium, from a supply to a received, comprising a rotary pump with a vertical rotor shaft, a closed buffer receptacle having a top and a bottom and which can be subjected to inner suction pressure and having a liquid inlet in the upper portion thereof and a liquid outlet in the lower portion thereof, means connecting the outlet of the buffer receptacle with the inlet of the pump, means for connecting the inlet of the buffer receptacle with the liquid supply, the pump having an downwardly directed axial inlet, a centrifugal pump rotor, a rotor housing, and a plurality of outlet ports extending substantially radially in a peripheral wall of the rotor housing, the pump being arranged on the top of said receptacle, the inlet of the pump being connected with the interior of the receptacle near the bottom thereof through a pipe conduit extending through said receptacle top.

4. A system according to claim 3, in which the buffer receptacle in the upper part thereof has means for connection with a source of inert gas.

5. A system according to claim 3, in which outside the rotor housing at a distance from the pump outlets a ring wall is mounted to provide a liquid container having a liquid level covering the pump outlets.

6. A system according to claim 3, in which the rotor is mounted on the free end of the rotor shaft, said shaft extending upwards from the pump and being supported at a distance above the rotor housing in a support frame mounted on the top of the buffer receptacle.

7. A system according to claim 6, in which the rotor housing has a cover loosely mounted on the rotor housing wall so that it can be lifted upwards, a distance member being provided between said cover and a portion of the support frame to prevent lifting during operation.

8. A system according to claim 5, in which the rotor housing has a cover loosely mounted on the rotor housing wall so that it can be lifted upwards, a distance member being provided between said cover and a portion of the support frame and in which the cover covers the rotor housing wall as well as the ring wall, said ring wall having at least one substantially radial outlet.

9. A system according to claim 3, in which the rotor is mounted on the free end of the rotor shaft, said shaft extending upwards from the pump and being supported at a distance above the rotor housing in a support frame mounted on the top of the buffer receptacle, and in which the support frame of the pump is divided horizontally into two parts, the driving shaft being journaled in the upper frame portion.

10. A system according to claim 3, in which a driving motor is arranged at the upper end of the pump rotor shaft.

11. A system according to claim 9, in which a driving motor is arranged at the upper end of the pump rotor shaft and supported by said support frame.

* * * * *